US007466280B2

(12) United States Patent
Noro et al.

(10) Patent No.: US 7,466,280 B2
(45) Date of Patent: Dec. 16, 2008

(54) PROTECTOR-EQUIPPED ANTENNA UNIT USING AN ALREADY-EXISTING ANTENNA UNIT AS AN ANTENNA BODY

(75) Inventors: Junichi Noro, Akita (JP); Kenichi Kamada, Akita (JP); Kyuichi Sato, Akita (JP)

(73) Assignee: Mitsumi Electric Co., Ltd., Tama-shi (JP)

( * ) Notice: Subject to any disclaimer, the term of this patent is extended or adjusted under 35 U.S.C. 154(b) by 0 days.

(21) Appl. No.: 11/291,647

(22) Filed: Nov. 30, 2005

(65) Prior Publication Data

US 2006/0187620 A1 Aug. 24, 2006

(30) Foreign Application Priority Data

Feb. 22, 2005 (JP) ..... 2005-045560

(51) Int. Cl.
*H01Q 1/32* (2006.01)

(52) U.S. Cl. ..... 343/713; 343/711

(58) Field of Classification Search ..... 343/711, 343/712, 713, 700 MS, 872
See application file for complete search history.

(56) References Cited

U.S. PATENT DOCUMENTS 5,689,276 A 11/1997 Uematsu et al.
5,900,840 A * 5/1999 Yajima ..... 343/713
6,384,791 B1 * 5/2002 Ikeda et al. ..... 343/713
6,714,171 B2 * 3/2004 Haussler et al. ..... 343/888
6,930,643 B2 * 8/2005 Byrne et al. ..... 343/702
2005/0225489 A1 * 10/2005 Aizawa et al. ..... 343/713
2006/0038726 A1 * 2/2006 Iacovella et al. ..... 343/713
2006/0187621 A1 8/2006 Noro et al.

FOREIGN PATENT DOCUMENTS

JP 2001-68912 A 3/2001

OTHER PUBLICATIONS

Related U.S. Appl. No. 11/291,649, filed Nov. 30, 2005; Inventor: J. Noro et al.

* cited by examiner

*Primary Examiner*—Hoang V Nguyen
*Assistant Examiner*—Robert Karacsony
(74) *Attorney, Agent, or Firm*—Frishauf, Holtz, Goodman & Chick, P.C.

(57) ABSTRACT

A protector-equipped antenna unit has an antenna body including an antenna case, a cable derived from the antenna case to the outside, and a protector having a shape corresponding to an outside shape of the antenna body and of the cable. Inasmuch as the protector-equipped antenna has the protector having the shape corresponding to the outside shape of the antenna body and of the cable, it is possible to use an already-existing antenna unit as the antenna body.

7 Claims, 5 Drawing Sheets

PROTECTOR-EQUIPPED ANTENNA UNIT USING AN ALREADY-EXISTING ANTENNA UNIT AS AN ANTENNA BODY

This application claims priority to prior Japanese patent application JP 2005-45560, the disclosure of which is incorporated herein by reference.

BACKGROUND OF THE INVENTION

This invention relates to an antenna unit mounted on a roof of a mobile body such as an automobile or the like and, in particular, to a protector-equipped antenna unit and an antenna protector for use in a digital radio receiver for receiving an electric wave from an artificial satellite (that may be called a "satellite wave") or an electric wave on the ground (that may be called a "terrestrial wave") to listen in a digital radio broadcasting.

In recent years, a digital radio receiver, which receives the satellite wave or the terrestrial wave to listen the digital radio broadcasting, has been developed and is put to practical use in the United States of America. The digital radio receiver is mounted on a mobile body such as an automobile and can receive an electric wave having a frequency of about 2.3 gigahertz (GHz) to listen in radio broadcasting. That is, the digital radio receiver is a radio receiver which can listen in a mobile broadcasting. Inasmuch as the received wave has the frequency of about 2.3 GHz, a reception wavelength (resonance frequency) $\lambda$ thereof is equal to about 128.3 mm. In addition, the terrestrial wave is an electric wave in which a signal where the satellite wave is received in an earth station is frequency shifted a little.

The antenna unit must be attached to a roof of the mobile body in a case where the digital radio receiver is mounted in the mobile body such as the automobile.

In order to attach the antenna unit to the roof of the mobile body, an antenna unit with a protector is known in the art.

In a conventional protector-equipped antenna unit, the antenna unit is manufactured by making engineering changes with new specific antenna parts manufactured therefor. In other words, the protector-equipped antenna unit is manufactured by making engineering changes of a plurality of antenna parts constituting an antenna body so as to enable to mount a protector thereon and by assembling the plurality of antenna parts made engineering changes and a plurality of protector parts constituting the protector.

In addition, as an antenna unit without a protector, an antenna unit for use in a GPS (global positioning system) receiver for receiving a GPS signal is known in the art (see, e.g. JP 2001-68912 A) although the antenna unit is not for use in the digital radio receiver. It is noted that the antenna unit for use in the digital radio receiver and the antenna unit for use in the GPS receiver are similar in structure and in the outside shape each other because they have frequencies of received electric waves and radiation patterns (antenna patterns) which are slightly different from each other.

In the manner which is described above, the conventional protector-equipped antenna unit must be manufactured by making engineering changes of a specific antenna unit (antenna body). As a result, the conventional protector-equipped antenna unit is disadvantageous in that it takes cost and time.

SUMMARY OF THE INVENTION

It is therefore an object of the present invention to provide a protector-equipped antenna unit which is capable of protecting an antenna body by using an already-existing antenna unit as the antenna body.

It is another object of the present invention to provide an antenna protector for protecting an antenna unit.

Other objects of this invention will become clear as the description proceeds.

According to a first aspect of this invention, a protector-equipped antenna unit is mounted on a roof of a mobile body. The protector-equipped antenna unit comprises an antenna body, a cable, and a protector. The antenna body includes an antenna case containing an antenna module therein. The cable is derived from the antenna case to an outside. The protector has a shape which corresponds to an outside shape of the antenna body and of the cable. The protector is for mounting the antenna body on the roof of the mobile body.

In the aforementioned protector-equipped antenna unit according to the first aspect of this invention, the protector may comprise an antenna mounting portion covering a bottom surface of the antenna case and an edge of the bottom surface thereof and a cable protecting portion for protecting the cable. The antenna mounting portion has a U-shape in cross section. The cable protecting portion is integrated with the antenna mounting portion. The protector-equipped antenna unit further may comprise an adhesive sheet for bonding the antenna mounting portion to the bottom surface of the antenna case. The protector-equipped antenna unit further may comprise a double-sided adhesive sheet for pasting the protector on the roof of the mobile body. Preferably, the protector may comprise an extending portion which is extended at an edge thereof downwards from a surface on which the double-sided adhesive sheet is pasted. The antenna body further may comprise at least one permanent magnet for magnetically attracting the antenna body to the roof of the mobile body.

According to a second aspect of this invention, an antenna protector is for protecting an antenna body including an antenna case containing an antenna module therein and a cable derived from the antenna case. The antenna protector comprises an antenna mounting portion covering a bottom surface of the antenna case and an edge of the bottom surface thereof and a cable protecting portion for protecting the cable. The antenna mounting portion has a U-shape in cross section. The cable protecting portion is integrated with the antenna mounting portion.

In the afore-mentioned antenna protector according to the second aspect of this invention, the antenna protector preferably may comprise an extending portion which is extended at an edge thereof downwards from a surface on which a double-sided adhesive sheet is pasted.

DESCRIPTION OF THE PREFERRED EMBODIMENT

Figure 1:
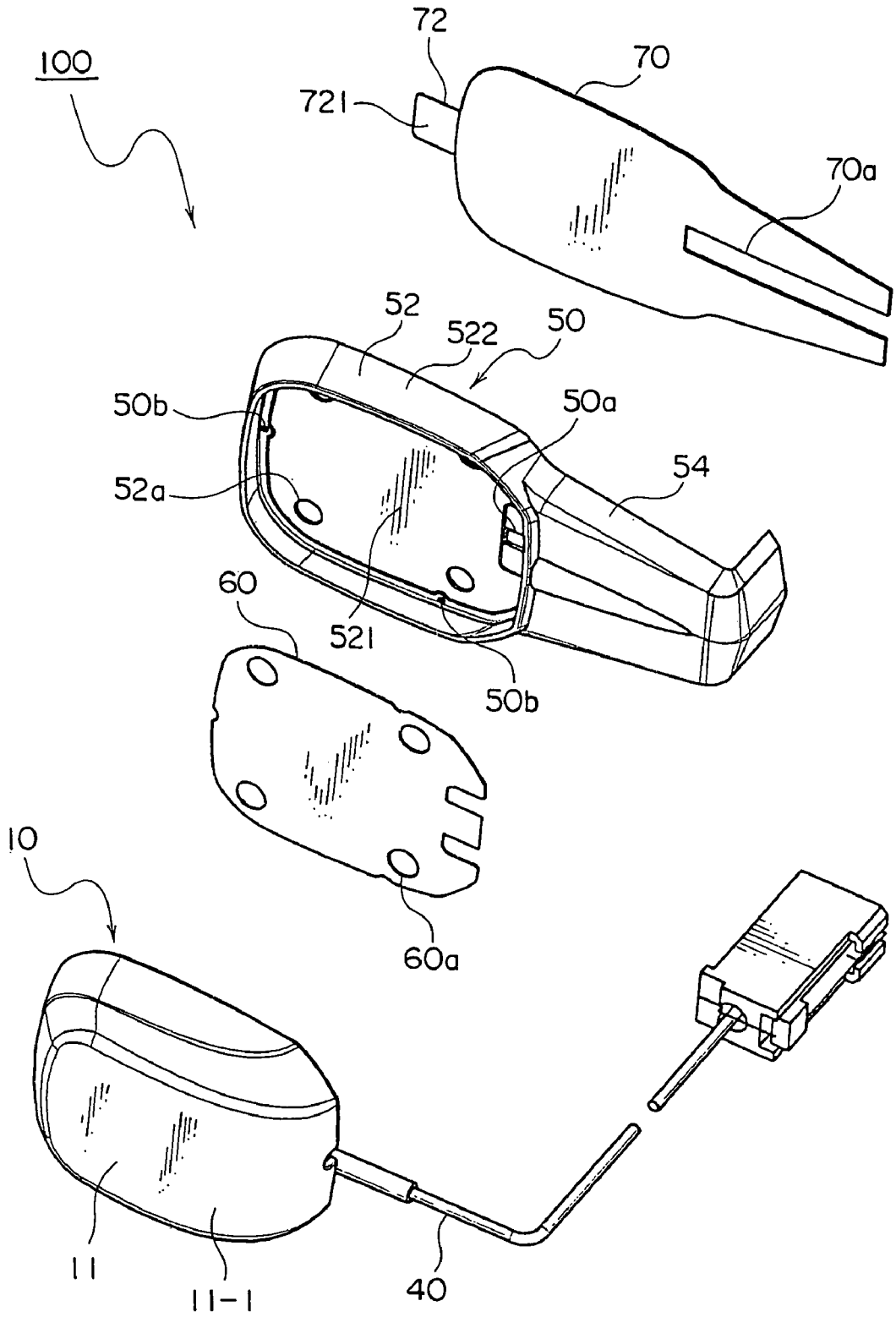
FIG. 1 is an exploded perspective view of a protector-equipped antenna unit according to an embodiment of this invention.

Referring to FIG. 1, the description will proceed to a protector-equipped antenna unit 100 according to an embodiment of the present invention. The illustrated protector-equipped antenna unit 100 is an antenna unit for use in a digital radio receiver and is used by attaching to a roof of a mobile body such as an automobile.

The protector-equipped antenna unit 100 comprises an antenna body 10, a cable 40, a protector (an antenna protector) 50, an adhesive sheet 60, and a double-sided adhesive sheet 70.

The antenna body 10 is an already-existing antenna unit and includes an antenna case 11 which contains an antenna module therein in the manner which will later be described. The cable 40 is derived from the antenna case 11 to the outside. The protector 50 is for protecting the antenna body 10 and the cable 40. The protector 50 has a shape corresponding to an outside shape of the antenna body 10 and the cable 40. The protector 50 is for use in mounting the antenna body 10 on the roof of the mobile body.

Inasmuch as the protector 50 has the shape corresponding to the outside shape of the antenna body 10 and of the cable 40, it is possible to protect the antenna body 10 by using the already-existing antenna as the antenna body 10.

More specifically, the protector 50 comprises an antenna mounting portion 52 and a cable protecting portion 54. The antenna mounting portion 52 is for covering a bottom surface of the antenna case 11 and an edge of the bottom surface thereof and substantially has a U-shape in cross section. The cable protecting portion 54 is integrated with the antenna mounting portion 52 and is for protecting the cable 40. The adhesive sheet 60 is for bonding the antenna mounting portion 52 to the bottom surface of the antenna case 11. The double-sided adhesive sheet 70 is for pasting the protector 50 on the roof of the mobile body.

The antenna mounting portion 52 comprises a bottom portion 521 having a shape corresponding to the bottom surface of the antenna body 11 and a ring-shaped frame portion 522 standing from an outer peripheral edge of the bottom portion 521 to cover the edge of the bottom surface of the antenna body 10.

In addition, the double-sided adhesive sheet 70 is pasted with a protection sheet 72. The protection sheet 72 consists of a protection portion (not shown) having a shape which is substantially similar to that of the double-sided adhesive sheet 70 and covering all of the double-sided adhesive sheet 70 and a tongue portion 721 extending from the protection portion. Accordingly, by peeling the protection sheet 72 from the double-sided adhesive sheet 70 with the tongue portion 721 grasped by fingers of a person to expose the double-sided adhesive sheet 70, it is possible for the double-sided adhesive sheet 70 to paste the protector-equipped antenna unit 100 on the roof of the mobile body.

In the example being illustrated, as the antenna body 10, the already-existing antenna unit having a structure similar to that disclosed in the above-mentioned JP 2001-68912 A is used.

Figure 2:
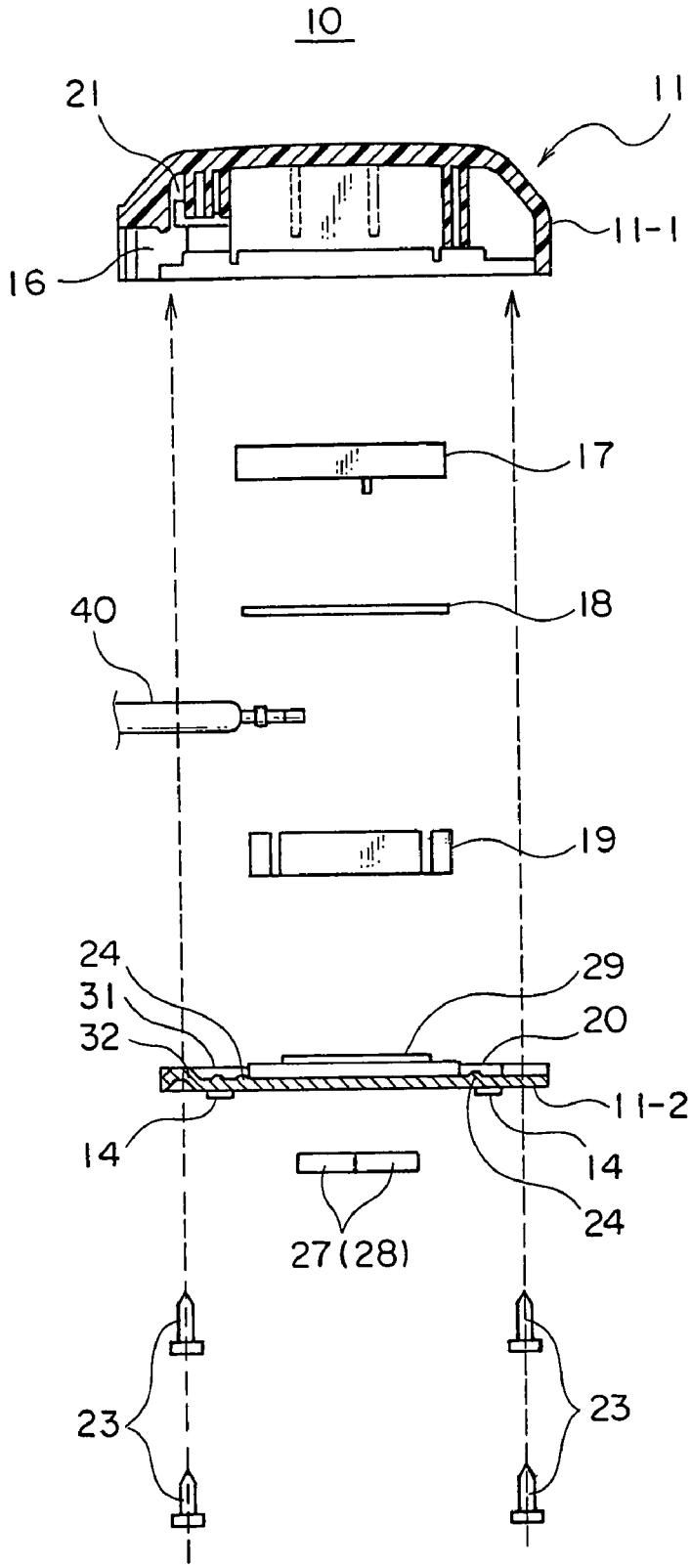
FIG. 2 is an exploded cross sectional view showing an antenna body for use in the protector-equipped antenna unit illustrated in FIG. 1.
Figure 3:
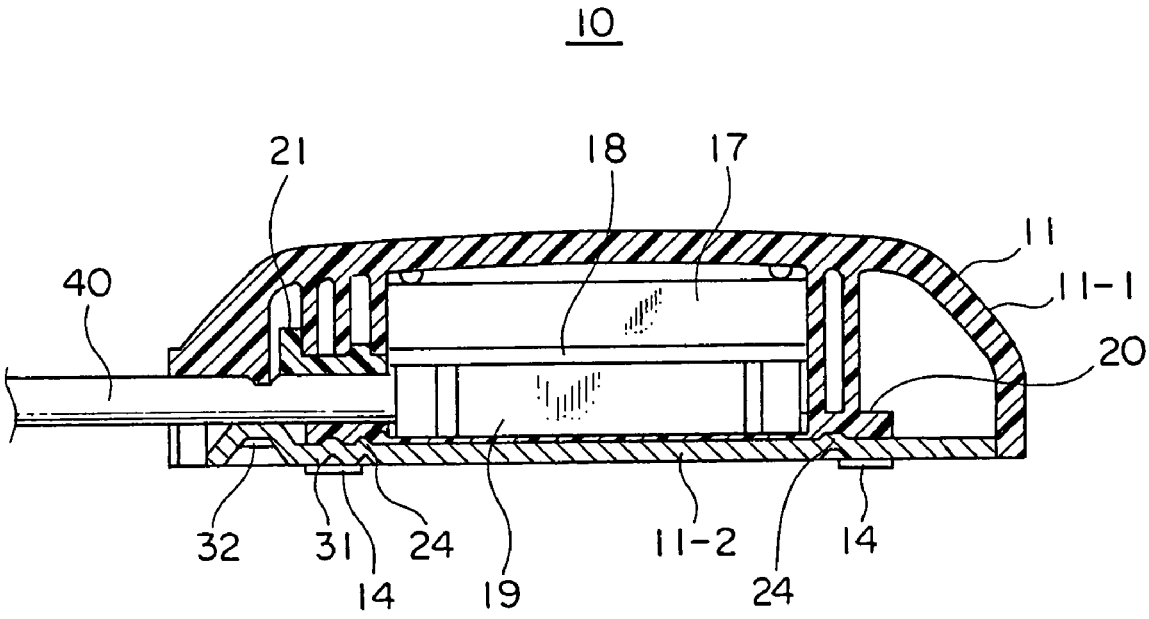
FIG. 3 is an enlarged cross sectional view of the antenna body illustrated in FIG. 2.

Referring to FIGS. 2 and 3, the description will proceed to the antenna body (the antenna unit) 10. The antenna case 11 comprises a dome-shaped top cover (upper case) 11-1 and a bottom plate (lower case) 11-2 which are jointed with each other. The top cover 11-1 has an interior in which an antenna module, which will later be described, is accommodated. The top cover 11-1 has an inverse U-shaped ditch 16 through which the cable 40 passes.

The antenna module comprises an antenna element 17, a circuit board 18, and a shielding case 19. On the antenna element 17, an antenna for receiving the satellite wave or the terrestrial wave is formed. On the circuit board 18, a signal processing circuit is formed. The signal processing circuit is a circuit for carrying out various signal processing such as signal amplification on a signal received by the antenna element 17. The antenna element 17 and the circuit board 18 are joined with each other by using a double-sided tape (not shown) or the like.

The circuit board 18 is connected to the cable 40 for picking the received signal to the outside. In addition, the circuit board 18 has a main surface, opposite to a surface on which the antenna element 17 is disposed, on which the shielding case 19 for shielding the above-mentioned signal processing circuit is mounted.

The antenna body 10 is constructed so that the above-mentioned antenna module, a rubber packing 20 having four rubber legs 14, a seal member 21 for sealing a mounting portion of the cable 40, and the bottom plate 11-2 are accommodated in the interior of the top cover 11-1.

The bottom plate 11-2 is made of stamped magnetic material such as stainless steel or the like and is integrated with a magnetic mounting portion 29. In addition, the bottom plate 11-2 is mounted to the top cover 11-1 so as to close a bottom opening the top cover 11-1 by threading four screws 23 into the top cover 11-1. On assembling, the bottom plate 11-2 is screwed and fixed to a bottom portion of the top cover 11-1 by the screws 23. On the magnet mounting portion 29, a pair of permanent magnets 27 and 28 magnetically attracted to a body of the automobile are mounted.

The magnet mounting portion 29 is formed so as to correspond to dimensions of the permanent magnets 27 and 28. When the permanent magnets 27 and 28 are mounted on the magnet mounting portion 29, the magnet mounting portion 29 serves as a back yoke so as to increase magnetic attraction force due to the permanent magnets 27 and 28, The bottom plate 11-2 has a rectangular seat portion 24 which is in contact with the rubber packing 20. The bottom plate 11-2 has four through holes (not shown) which are provided outside of the seat portion 24 and through which the four screws 23 pass. In addition, the bottom plate 11-2 has other four through holes which are provided at four outer corners of the seat portion 24 and through which the four rubber legs 14 pass.

Furthermore, the bottom plate 11-2 has a convex portion 31 formed in parallel with the seat portion 24 at a portion where the seal member 21 is in contact with and a supporting portion 32 for supporting the cable 40 at a predetermined height. The convex portion 31 pushes a portion of the rubber packing 20 where the cable 40 passes through in conjunction with the seat portion 24 to act as so as to increase seal effect for the cable 40.

Inasmuch as the protector-equipped antenna unit 100 according to this embodiment comprises the protector 50 having the shape corresponding the outside shape of the antenna body 10 and of the cable 40 in the manner which is described above, it is possible to use the already-existing antenna unit as the antenna body 10. As a result, it is unnecessary for the protector-equipped antenna unit 100 to manufacture a plurality of new specific antenna parts like the conventional protector-equipped antenna unit.

Turning back to FIG. 1, the adhesive sheet 60 has four through holes 60*a* through which the four rubber legs 14 pass. In addition, the antenna mounting portion 52 has four insertion holes 52*a* through which the four rubber legs 14 pass.

Figure 4:
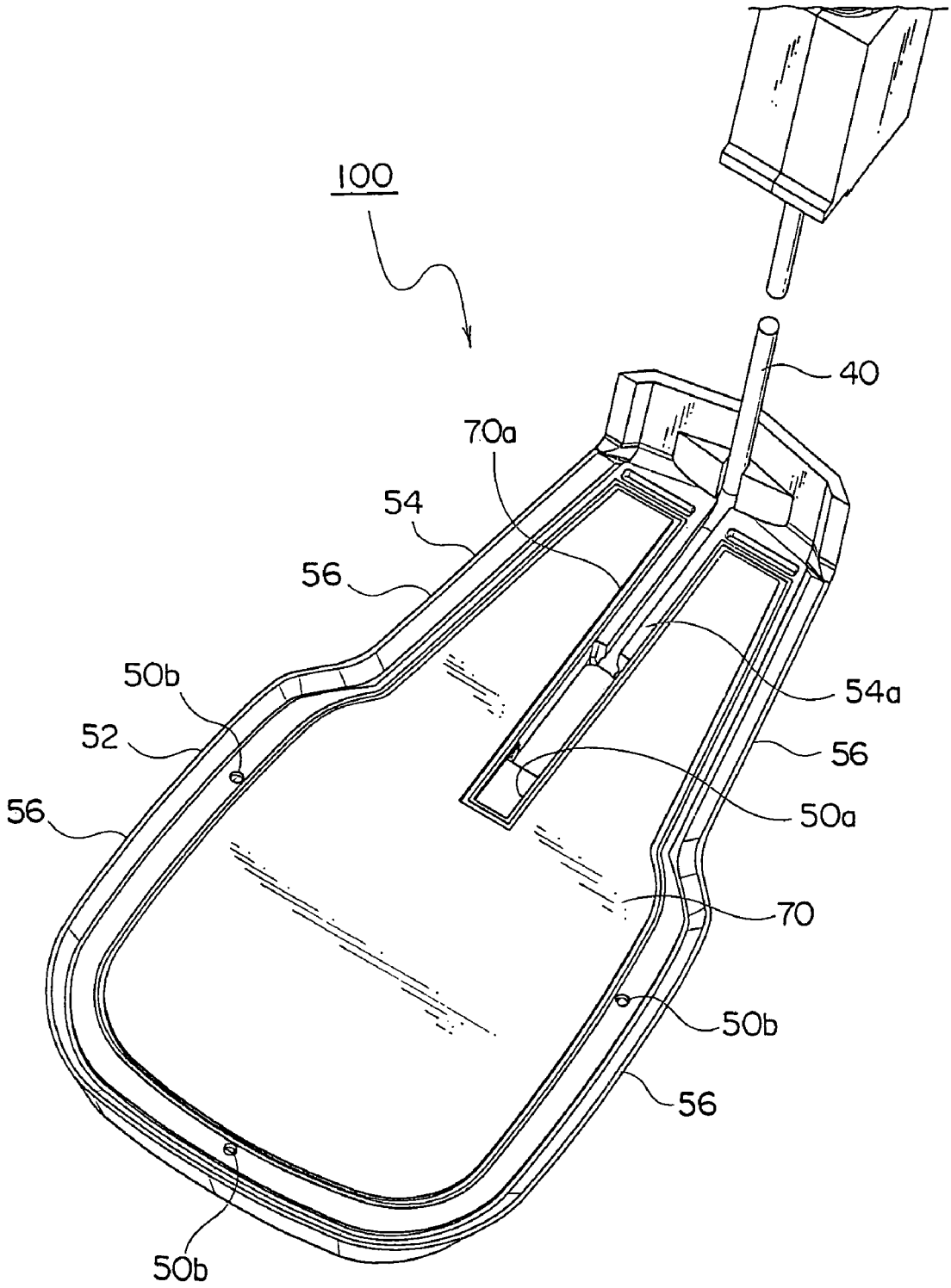
FIG. 4 is a perspective view of the protector-equipped antenna unit illustrated in FIG. 1 seen from a bottom surface side.

FIG. 4 is a perspective view of the protector-equipped antenna unit 100 illustrated in FIG. 1 seen from a bottom surface side.

Referring to FIG. 4 in addition to FIG. 1, the protector 50 has first and second drain holes 50*a* and 50*b*. The first drain hole 50*a* is formed in the bottom surface of the protector 50 along the cable 40. The second drain holes 50*b* are formed at three locations in the bottom portion 521 of the antenna mounting portion 52 outside the adhesive sheet 60 and the double-sided adhesive sheet 70. Although the second drain holes 50*b* are formed at only three locations in the bottom portion 521 of the antenna mounting portion 52 in this embodiment, the number of the second drain holes 50*b* may not be restricted to three and may be any number.

The double-sided adhesive sheet 70 has a rectangular slit 70*a* formed therein. The rectangular slit 70*a* has a shape which corresponds to that of the first drain hole 50*a* and which is slightly larger than that of the first drain hole 50*a*.

As shown in FIG. 4, the protector (the antenna protector) 50 has an extending portion 56 where the edge portions of the ring-shaped frame portion 522 and the cable protecting portion 54 are extended downwards. The extending portion 56 has a shape projected downwards from a bottom surface on which the double-sided adhesive sheet 70 is pasted. The extending portion 56 is formed along an outer peripheral portion of the protector 50. Therefore, the double-sided adhesive sheet 70 is hidden without spoiling the beauty of an external view of the protector-equipped antenna unit 100, and it is possible to proof dust in the double-sided adhesive sheet 70.

Figure 5:
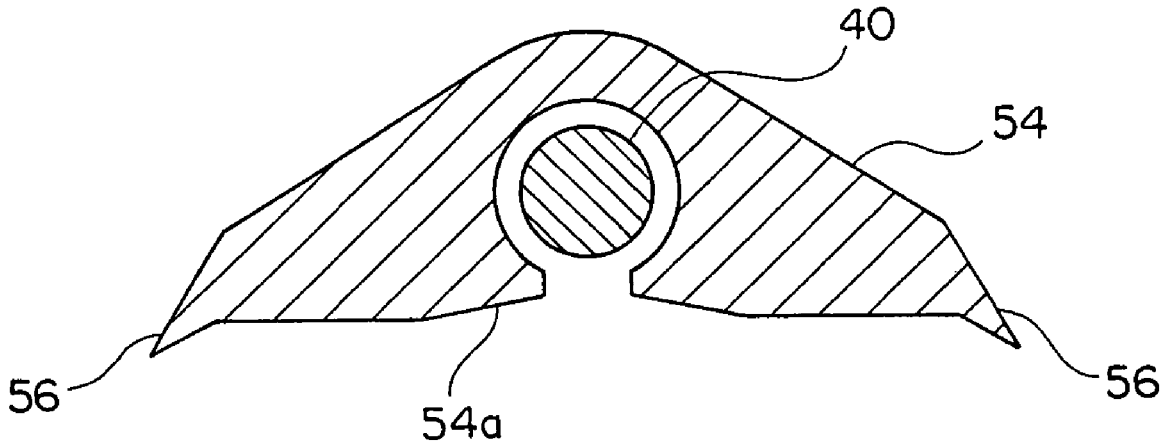
FIG. 5 is a cross sectional view showing a state where a cable is fixed in a cable protecting portion of a protector for use in the protector-equipped antenna unit illustrated in FIG. 1.

FIG. 5 is a cross-sectional view showing a state where the cable 40 is fixed in the cable protecting portion 54 of the protector 50. The cable protecting portion 54 has a hook portion 54*a* for fixing the cable 40 thereto. By the hook portion 54*a*, it is possible to easily position and fix the cable 40 to the cable protecting portion 54.

While this invention has thus far been described in conjunction with a preferred embodiment thereof, it will now be readily possible for those skilled in the art to put this invention into various other manners. For example, although the protector-equipped antenna unit described in the above-mentioned embodiment is suitable for the antenna unit for use in the digital radio receiver, the protector-equipped antenna unit according to this invention may not be restricted to this and may be applicable to an antenna unit for use in a GPS signal receiver or antenna units for use in mobile communications for receiving other satellite waves or other terrestrial waves.

What is claimed is:

1. A protector-equipped antenna unit mountable on a roof of a mobile body, said protector-equipped antenna unit comprising:

an antenna body which includes an antenna case containing an antenna module, wherein the antenna case comprises a top cover and a bottom plate;

a cable projecting outwardly from said antenna case in a horizontal direction; and a protector which has a shape that corresponds to an external shape of said antenna body and of said cable, wherein said protector mounts said antenna body on the roof of said mobile body, and wherein said protector comprises:

an antenna mounting portion which covers a bottom surface of said antenna case and an edge of said bottom surface, and which has a U-shape in cross-section; and a cable protecting portion which protects said cable, and which is integrated with said antenna mounting portion.

2. The protector-equipped antenna unit as claimed in claim 1, further comprising an adhesive sheet which bonds said antenna mounting portion to the bottom surface of said antenna case.

3. The protector-equipped antenna unit as claimed in claim 1, further comprising a double-sided adhesive sheet which pastes said protector on the roof of said mobile body.

4. The protector-equipped antenna unit as claimed in claim 3, wherein said protector comprises an extending portion which extends at an edge thereof from a bottom surface side of said protector on which said double-sided adhesive sheet is pasted.

5. The protector-equipped antenna unit as claimed in claim 1, wherein said antenna body further comprises at least one permanent magnet which magnetically attracts said antenna body to the roof of said mobile body.

6. An antenna protector which protects: (i) an antenna body which includes an antenna case containing an antenna module, wherein the antenna case comprises a top cover and a bottom plate, and (ii) a cable projecting outwardly from said antenna case in a horizontal direction, wherein said antenna protector comprises:

an antenna mounting portion which covers a bottom surface of said antenna case and an edge of said bottom surface, and which has a U-shape in cross section; and a cable protecting portion which protects said cable, and which is integrated with said antenna mounting portion.

7. The antenna protector as claimed in claim 6, wherein said antenna protector comprises an extending portion which extends at an edge thereof from a bottom surface side of said antenna protector on which a double-sided adhesive sheet is pasted.

* * * * *